United States Patent [19]

Stout

[11] 3,982,433

[45] Sept. 28, 1976

[54] SPINNER TOOL FOR BOREHOLES

[75] Inventor: Beauford F. Stout, Grandview, Tex.

[73] Assignee: Worthwell Surveys, Inc., Forth Worth, Tex.

[22] Filed: Dec. 5, 1974

[21] Appl. No.: 530,015

[52] U.S. Cl. ..... 73/155

[51] Int. Cl.[2] ..... E21B 47/10

[58] Field of Search ..... 73/155, 151, 229, 253

[56] References Cited

UNITED STATES PATENTS

| | | | |
|---|---|---|---|
| 644,487 | 2/1900 | Zumkeller | 73/229 |
| 2,558,427 | 6/1951 | Fagan | 73/151 |
| 2,636,479 | 4/1953 | Smyser | 73/253 |
| 2,786,351 | 3/1957 | Wiley et al. | 73/155 |

FOREIGN PATENTS OR APPLICATIONS

| | | | |
|---|---|---|---|
| 541,078 | 7/1922 | France | 73/253 |
| 258,995 | 4/1970 | U.S.S.R. | 73/155 |

*Primary Examiner*—James J. Gill
*Assistant Examiner*—Anthony V. Ciarlante
*Attorney, Agent, or Firm*—Richards, Harris and Medlock

[57] ABSTRACT

A spinner tool comprises an elongate, cylindrical housing including a portion having elongate, axially extending, angularly disposed slots formed therethrough at circumferentially spaced points. An impeller is mounted within the housing and comprises circumferentially spaced, axially extending blades which are each J-shaped in cross-section so that the impeller is rotated in response to radially directed fluid flow entering the slots of the housing, but is not rotated in response to axial fluid flow. The impeller is mounted on a shaft which is supported by bearing structure that is substantially self-cleaning under the action of fluids flowing through the housing. A plurality of magnets are secured to the shaft for rotation under the action of the impeller, and a reed switch is positioned for actuation by the moving magnets to generate an output signal indicative of rotation of the impeller. Electronic circuitry is provided in the housing for amplifying and shaping the output signal from the reed switch. The spinner tool is utilized in a well logging system including apparatus for lowering the spinner tool into a borehole and a recorder for providing a plot of the rotation of the impeller as a function of the position of the spinner tool in the borehole.

15 Claims, 6 Drawing Figures

SPINNER TOOL FOR BOREHOLES

BACKGROUND AND SUMMARY OF THE INVENTION

This invention relates to a spinner tool for boreholes, and more particularly to a tool for accurately locating points of fluid entry into producing petroleum wells.

In the operation of boreholes such as petroleum wells and the like, it is sometimes desirable to perform various logging operations. Such logging operations are carried out by lowering a tool into the borehole in such a way as to continuously monitor the positioning of the tool. The tool is provided with transducers responsive to one or more operating parameters of the borehole, such as temperature, fluid flow rate, etc. In this manner there is prepared a record or chart upon which the operating parameters of the borehole as measured by the tool are plotted against the depths of the borehole.

Although prior logging tools have provided much valuable information, they have generally been unsuccessful in identifying the precise location in the well at which fluids are entering the casing of the well. For example, on the assumption that any substantial fluid flow would cause cooling, attempts have been made to utilize temperature measurements to identify points at which fluid is entering the well casing. It has been found, however, that the fluid may flow for a substantial distance along the outside of the casing, and that when this occurs a temperature sensitive well logging tool is incapable of identifying the precise point at which fluid is entering the casing. Various spinner devices have also been utilized heretofore to measure fluid flow, and attempts have been made to utilize such devices to identify the point at which fluid is entering the casing. However, the prior art spinner tools have been responsive to overall fluid flow upwardly in the casing, and for this reason have been less than wholly satisfactory in precisely identifying the point of fluid entry into the well casing.

The present invention comprises a spinner tool for use in boreholes and the like which overcomes the foregoing and other difficulties long since associated with the prior art. In accordance with the broader aspects, a spinner tool includes a rotor mounted for rotation about a normally vertically disposed axis and having a plurality of axially extending rotor blades. The rotor is mounted in a housing having a plurality of axially disposed, angularly extending slots formed therein. The rotor is thus rotated under the action of fluid flowing radially, but is not rotated under the action of fluid flowing axially. In this manner the spinner tool is adapted to provide an output indicative of the precise location at which fluid is entering a borehole.

In accordance with more specific aspects of the invention, the rotor is supported in the housing by means of bearing structure which is effectively self-cleaning. A plurality of permanent magnets are mounted in the upper portion of the rotor for rotation therewith. The magnets function to open and close a switching device, and circuitry is provided in the tool for amplifying and shaping the resulting output signal. This signal is transmitted to the surface where it is recorded by means of conventional recording apparatus to provide a record or chart showing the precise location at which fluid is entering the borehole.

DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
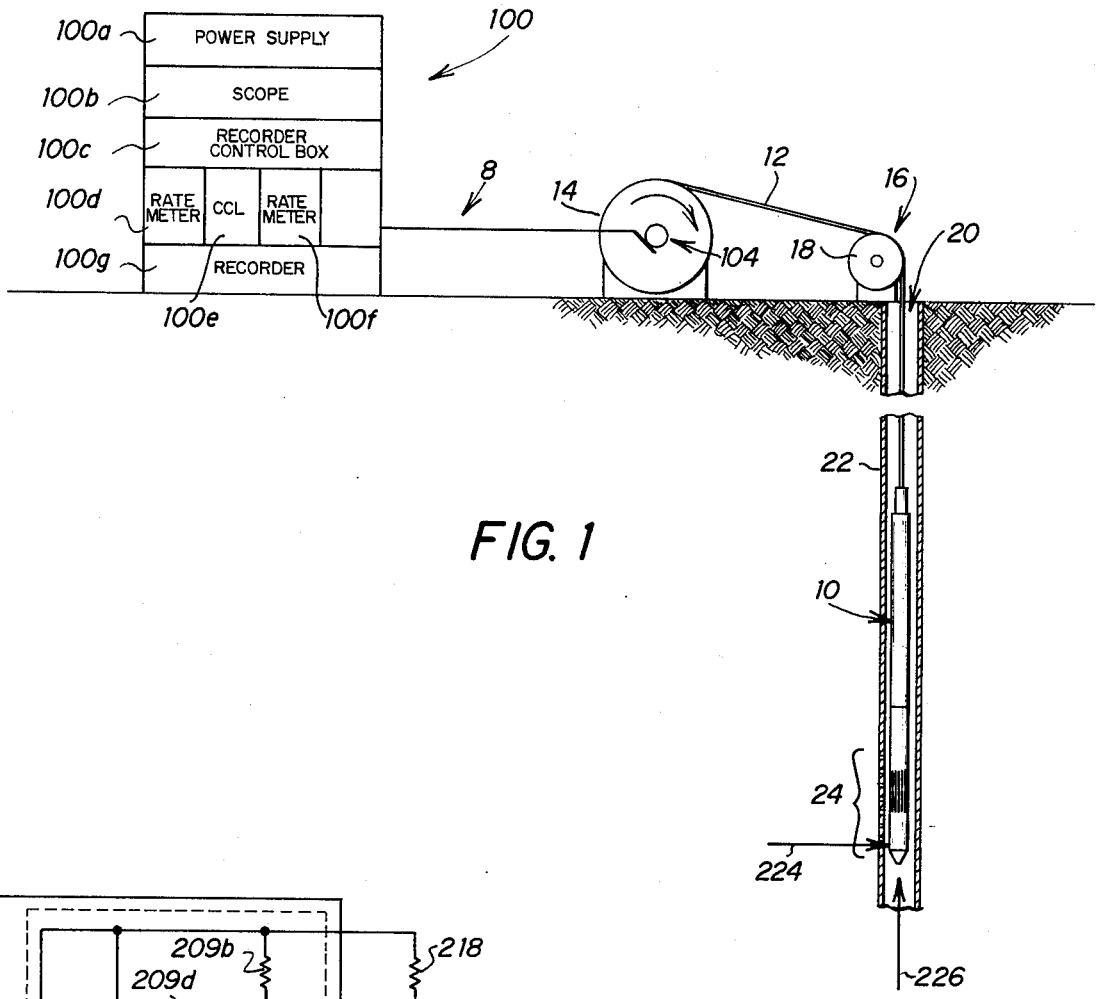
FIG. 1 is an illustration of a well logging system utilizing a spinner tool incorporating the present invention.

Referring now to the Drawings, and particularly to FIG. 1 thereof, there is shown a well logging system 8 utilizing a spinner tool 10 incorporating the present invention. The well logging system 8 includes a cable 12 extending from a drum 14 through a measuring device 16 including a capstan 18 into a borehole 20 and connected at the distal end thereof to the spinner tool 10. The borehole 20 includes a steel casing 22 and is preferably of the type commonly associated with petroleum wells and the like. As such, the casing 22 of the borehole 20 may be provided with one or more perforations or sets of perforations, as at 24.

Figure 2:
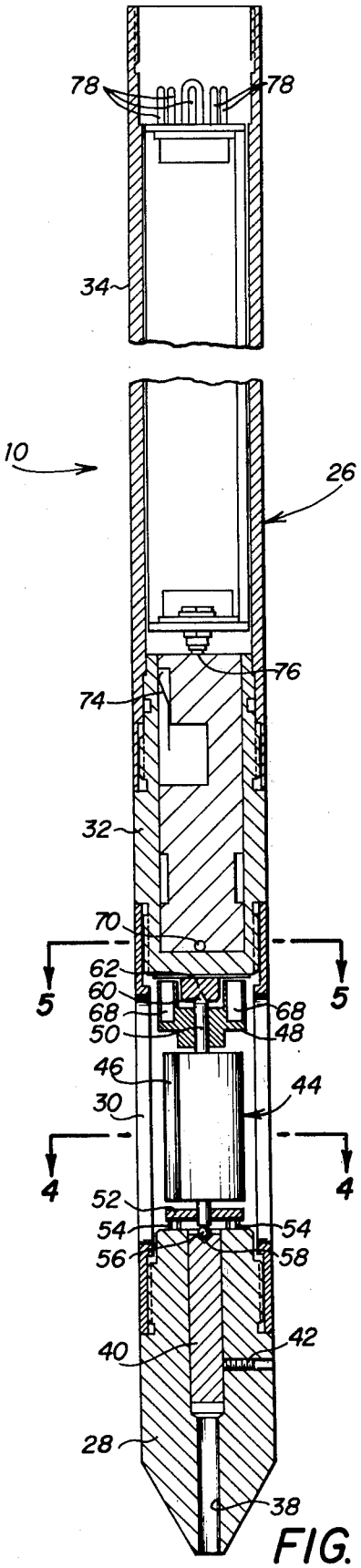
FIG. 2 is a longitudinal sectional view of the spinner tool of FIG. 1.

As is best shown in FIG. 2, the spinner tool 10 includes a housing 26 comprising threadedly interconnected sections 28, 30, 32 and 34. The housing section 28 comprises a bull plug and has an axially extending passageway 36 formed therein. The upper portion of the passageway 38 is enlarged and receives a lower bearing mount 40. The positioning of the lower bearing mount 40 in the passageway 38 is adjustable by means of a set screw 42.

A rotor assembly 44 is rotatably supported in the housing section 30 and includes an impeller 46 and a magnet assembly 48 both of which are secured to a shaft 50 for rotation therewith. The lower end of the shaft 50 is positioned by a shaft support member 52 which is supported on the upper end of the housing section 28 by spacers 54. The lower end of the shaft 50 rotatably engages a ball 56 which is rotatably received in a conical aperture formed in the upper end of the lower bearing mount 40, whereby the rotary assembly 44 is rotatably supported. This particular bearing arrangement has been found to be highly advantageous in that it is substantially self-cleaning under the action of fluids flowing around and into the spinner tool 10. It will be noted in this regard that the lower bearing assembly and the adjacent housing portions are entirely open to facilitate such fluid flow. The upper end 60 of the shaft 50 is conically shaped and is received in a similarly shaped aperture formed in an upper bearing mount 62 which depends from the housing section 32.

Figure 3:
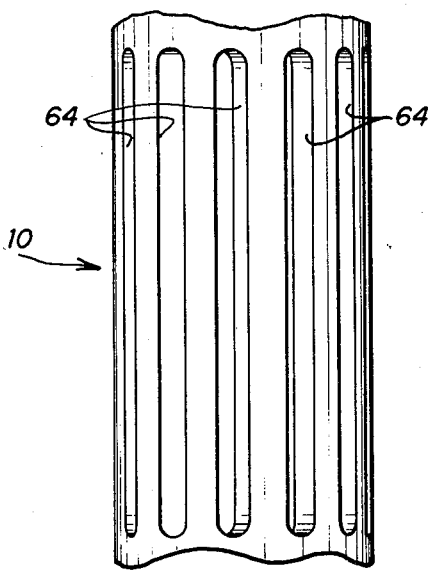
FIG. 3 is a side view of a portion of the spinner tool.
Figure 4:
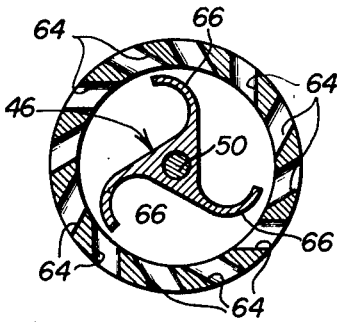
FIG. 4 is a sectional view taken generally along the lines 4—4 in FIG. 2 in the direction of the arrows.

Referring to FIGS. 3 and 4, the housing section 30 has a plurality of slots 64 formed therein at circumferentially spaced points. Each of the slots 64 extend axially relative to the spinner tool 10 but is substantially angularly disposed relative to a diameter of the spinner tool 10 extending therethrough. The impeller 46 of the rotor assembly 44 has three circumferentially spaced, axially extending, generally J-shaped blades 66. These J-shaped blades 66 of the impeller 46 cooperate with the angularly disposed slots 64 to cause rotation of the rotor assembly 44 in response to fluid flow which is radially directed relative to the spinner tool. Conversely, the arrangement of the slots 64 and the J-shaped blades 66 of the impeller 46 is such that the rotor assembly does not rotate in response to axially directed fluid flow relative to the spinner tool.

Figure 5:
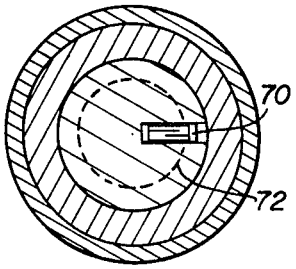
FIG. 5 is a sectional view taken generally along the lines 5—5 in FIG. 2 in the direction of the arrows.

Referring again to FIG. 2, the magnet assembly 48 of the rotor assembly 44 has a plurality of permanent magnets 68 mounted therein. Thus, upon rotation of the rotor assembly 44 under the action of the impeller 46, the permanent magnets 68 follow a circular path. A reed switch 70 is mounted in the housing section 32. As is best shown in FIG. 5, the reed switch 70 is disposed directly above the circular path 72 of the magnets 68. Thus, upon rotation of the magnets 68 the reed switch 70 is cyclically opened and closed at a frequency dependent upon the speed of rotation of the rotor assembly 44.

One contact of the reed switch 70 is connected to ground through a contact 74. The other contact of the reed switch 70 is connected to electronic circuitry located within the housing section 34 through a contact 76. The electronic circuitry within the housing section 34 is in turn connected to the cable 12 by means of a plurality of pins 78.

Referring again to FIG. 1, the well logging system 8 includes an electronic console 100 having a power supply 100a which is shown in electrical communication with the cable 12 having the spinner tool 10 attached thereto. More particularly, the cable 12 is fed from the drum 14 with the length and the weight of the cable being measured by the capstan 18. The spinner tool 10 is thereby lowered into the borehole 20 to detect fluid flow in a perforated well casing or the like. For example, the spinner tool may be used to locate the point at which gas is entering the well.

A transverse or radial fluid flow engaging the spinner tool 10 will cause the rotor assembly 44 to rotate. During each 360° rotation of the rotor assembly, the magnets 68 will pass in registration with the reed switch 70 to produce an electrical pulse on the cable 12. The rate at which the pulses are produced is determined by the rate of rotation of the rotor assembly 44.

As the pulse train travels up the cable 12, each pulse is picked off by means of slip rings 104 in electrical communication with the cable and physically secured to the axis of the drum 14. The pulses are displayed at the console 100 by an oscilloscope **100*b*, converted to a DC voltage by rate meters 100*d* and 100*f*, and recorded by a DC recorder 100*g***.

In addition, a CCL (casing collar locator) circuit 209 generates a signal upon detecting metal collars in the well casing 22. The signal is transmitted along the cable 12, picked off from slip rings 104, and processed by the CCL circuitry **100*e* at the console 100**.

Figure 6:
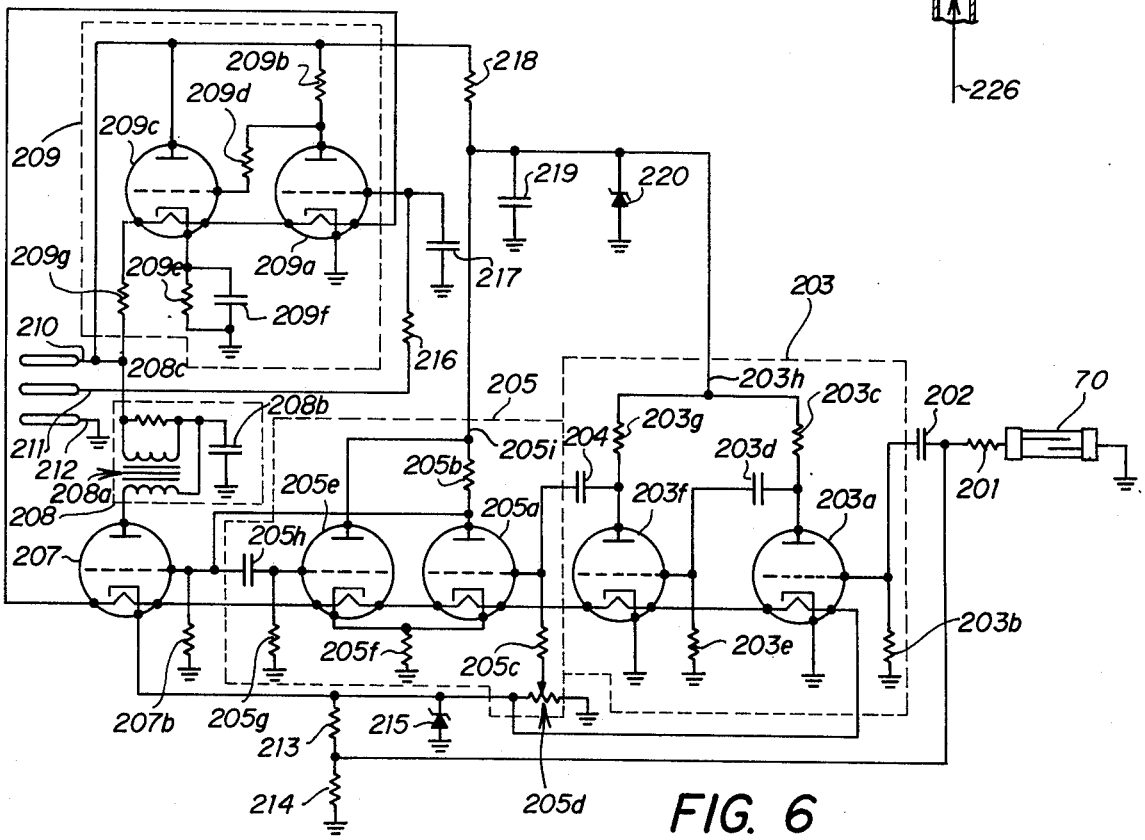
FIG. 6 is a schematic illustration of electronic circuitry utilized in the spinner tool of FIG. 2.

The spinner tool electronic circuitry is illustrated in schematic form in FIG. 6, wherein the output of reed switch 70 is connected through resistor 201 and capacitor 202 to the input of a two-stage amplifier 203. More particularly, capacitor 202 is connected directly to the grid input of a triode **203*a*, and through a resistor 203*b* to ground. The cathode of 203*a* is grounded, while the plate is connected through a load resistor 203*c* to a B+ or plate voltage line 203*h*. In like manner, the plate of triode 203*f* is connected through a load resistor 203*g* to line 203*h*. The plate of triode 203*a* is also connected through a capacitor 203*d* to the grid input of triode 203*f* and through resistor 203*e* to ground. The cathode of triode 203*f* is connected to ground, while the plate is connected through a capacitor 204 to a pulse shaping circuit 205**.

Circuit 205 includes a triode **205*a* having a grid connected to capacitor 204, and connected through resistor 205*c* to the arm of a potentiometer 205*d*. The plate of triode 205*a* is connected through a load resistor 205*b* to a B+ or plate voltage line 205*i*, while the plate of triode 205*e* is connected directly to line 205*i*. The cathodes of triodes 205*e* and 205*a* are connected in parallel through a resistor 205*f* to ground. The grid of triode 205*e* is connected through a resistor 205*g* to ground, and through a capacitor 205*h* to the plate of triode 205*a* and to a terminal of a capacitor 206**.

The opposite terminal of capacitor **205*h* is connected through a resistor 207*b* to ground and to the grid of a triode 207. The cathode of triode 207 is connected through resistor 213 to a node intermediate to resistor 201 and capacitor 202. The cathode is also connected through resistors 213 and 214 to ground, to the cathode of a Zener diode 215 having an anode at ground potential, and to one terminal of the resistor contained within potentiometer 205*d***. The opposite terminal of the resistor is at ground potential.

The plate of triode 207 is connected through a matching transformer circuit 208 to an output line 210. Circuit 208 includes a transformer **208*a* having one terminal of a primary coil connected to the plate of triode 207, and a second terminal of the primary coil connected through a capacitor 208*b* to ground and to the corresponding terminal of a secondary coil. The secondary coil is in parallel with a resistor 208*c* which is connected between the positive terminal of capacitor 208*b* and output line 210**.

A second input line 211 is connected through a resistor 216 to a CCL (casing collar locator) circuit 209, and through a capacitor 217 to ground. More particularly, CCL circuit 209 includes a triode **209*a*, the grid of which is connected to resistor 216 and to the positive terminal of capacitor 217. The plate of triode 209*a* is connected through a resistor 209*b* to the plate of a triode 209*c*, and through a resistor 209*d* to the grid of a triode 209*c*. The cathode of triode 209*a* is connected to ground. The plate of triode 209*c* is connected to line 210, while the cathode is connected through a parallel circuit comprising a resistor 209*e* and a capacitor 209*f*** to ground.

Plate voltage for CCL circuit 209 is provided by a circuit including resistor 218, capacitor 219 and Zener diode 220. The cathode of diode 220 is connected through resistor **203*c* to the plate of triode 203*a*, through resistor 203*g* to the plate of triode 203*f*, and to the high potential terminal of capacitor 219. A second terminal of capacitor 219 and the anode of diode 220 are each connected to ground. The high potential terminal of capacitor 219 is connected through resistor 218 to the plate of triode 209*c*, and through resistors 218 and 209*b* to the plate of triode 209*a*. In addition, the high potential terminal is connected to the plate of triode 205*e*, and through resistor 205*b* to the plate of triode 205*a***.

The heater element voltages of the triodes illustrated in FIG. 6 are provided by a series circuit leading from the cathode of diode 215 and incliuding in series the heater elements of triodes **203*a*, 203*f*, 205*a*, 205*e*, 207**, 209*a* and 209*c*, and terminating through resistor 209*g* to output line 210.

In operation, a pulse train is produced by means of the magnet 68 passing in registration with the reed switch 70. The pulse train is amplified by two-stage amplifier 203, shaped by circuit 205, and then output through triode 207 and matching transformer 208*a* to line 210 leading to the cable 12 of FIG. 1.

When a metal collar is located in a well casing, signals in the form of DC shifts in line voltage are received along line 211 and applied to CCL circuit 209, which restores the DC level before outputting the pulses on line 210.

Referring again to FIG. 1, it will thus be understood that the spinner tool 10 is responsive to fluid flow having a substantial transverse or radial component. For example, the spinner tool 10 would produce an output indicative of gas entering the borehole 20 through the perforations 24 and the casing 22 in the manner illustrated by the arrow 224. Such an output comprises a series of pulses which are directed upwardly through the cable 12 and are in turn directed to the console 100 through the slip rings 104. The console 100 thereupon functions in conjunction with the measuring device 16 to provide a record or chart whereby the location of such fluid flow is plotted as a function of the depth of the borehole. Conversely, the spinner tool 10 does not produce an output in response to axially directed fluid flow as indicated by the arrow 226. In this manner the well logging system 8 functions to provide a highly accurate record of each point at which fluid is entering the borehole 20.

From the foreging, it will be understood that the use of the present invention results in numerous advantages over the prior art. Perhaps the most important advantage deriving from the use of the invention relates to the fact that by means thereof it is possible to locate each point at which fluid is entering a borehole in a highly accurate manner. Another advantage in the use of the invention involves the fact that spinner tools constructed in accordance therewith incorporate an improved bearing arrangement which is substantially self-cleaning under the action of fluids flowing around and into the spinner tool. Still another advantage deriving from the use of the invention involes the fact that spinner tools constructed in accordance therewith are adapted for manufacture from a relatively small number of easily fabricated parts, and are therefore economical to manufacture and use while simultaneously being adapted for long term, substantially maintenance free service.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

What is claimed is:

1. A spinner tool for detecting radially directed fluid flow in boreholes comprising:

an elongate, cylindrical housing;

a portion of the housing having a plurality of axially extending, angularly disposed slots formed therein at spaced apart points around the circumference of the housing;

an impeller rotatably supported in the housing and comprising a plurality of axially extending rigid blades positioned in alignment with the slots of the housing for actuation by fluid flow therethrough;

the blades having a substantially J-shaped cross-section and extending adjacent to the angularly disposed slots to resist radially directed fluid flow therethrough;

means responsive to rotation of the impeller under the action of fluid flowing through the slots in the housing for generating an output signal;

a shaft having the impeller mounted thereon;

the lower end of the shaft being rotatably supported on a ball which is in turn supported on the housing; and the point of the shaft which engages the ball being exposed to the radially directed fluid flow through the angularly disposed slots to allow self-cleaning thereof.

2. The spinner tool according to claim 1 wherein the output signal generating means is further characterized by at least one magnet mounted for rotation with the impeller, and means responsive to the magnet for generating the output signal.

3. The spinner tool according to claim 2 wherein the magnet responsive means comprises magnetically responsive switch means mounted adjacent to the path of rotation of the magnet.

4. The spinner tool according to claim 1 further including means supported on the housing and spaced a predetermined distance above the ball for receiving the shaft and thereby maintaining alignment of the shaft with the ball and for allowing radially directed fluid flowing through the angularly disposed slots to flow around the point where the shaft engages the ball.

5. The spinner tool according to claim 4 wherein the upper end of the shaft is conically shaped and is received in a similarly shaped aperture formed in the housing.

6. The spinner tool according to claim 1 wherein the rigid J-shaped blades extend radially outward from the center axis and terminate some predetermined relatively short distance from the opposing interior surface of the cylindrical housing.

7. A spinner tool for detecting radially directed fluid flow in boreholes comprising:

an elongate, cylindrical housing including a portion having a plurality of substantially axially extending slots formed therethrough at circumferentially spaced points;

an impeller rotatably supported in the housing and comprising a plurality of substantially axially extending rigid blades positioned in alignment with the slots of the housing whereby the impeller is rotated in response to radially directed fluid flow entering the slots but is not rotated in response to axially directed fluid flow;

the blades extending adjacent to the slots to thereby offer resistance to radially directed fluid flowing at any point through the slots;

at least one magnet mounted for rotation relative to the housing under the action of the impeller;

means mounted in the housing and responsive to movement of the magnet for generating an output signal indicative of the speed of rotation of the impeller under the action of radial fluid flow entering the slots of the housing;

said impeller being mounted on the shaft; and the bottom of the shaft being rotatably supported on a ball which is in turn rotatably supported on a portion of the housing, said shaft engaging the ball in an area of the housing where fluid flows through to allow self-cleaning of the ball.

8. The spinner tool according to claim 7 wherein each slot on the housing is angularly disposed relative to a diameter of the housing extending therethrough.

9. The spinner tool according to claim 7 wherein each of the axially extending blades of the impeller is substantially J-shaped in cross-section.

10. The spinner tool according to claim 5 further characterized by means mounted on the housing for receiving the shaft to maintain alignment thereof with the ball, and wherein the alignment maintaining means is supported on the housing and spaced a predetermined distance above the ball so that the rotational support of the shaft is substantially self-cleaning under the action of fluid flow through the slots.

11. The spinner tool according to claim 7 wherein the portion of the housing rotatably supporting the ball is movable in an axial direction for adjusting the engagement of the ball with the bottom of the shaft.

12. A spinner tool for detecting radial fluid flow in a borehole comprising:

an elongate cylindrical housing including a portion having elongate, axially extending, angularly disposed slots formed therethrough at circumferentially spaced points;

an impeller rotatably supported in the housing and comprising a plurality of circumferentially spaced rigid blades extending axially adjacent to the slots and each J-shaped in cross section, said blades being aligned with the slots in the housing such that the impeller is rotated under the action of radially directed fluid flow entering the slots of the housing;

means mounted within the housing for generating an output signal indicative of rotation of the impeller under the action of radially directed fluid flow entering the slots of the housing;

electronic circuitry means mounted within the housing for amplifying and shaping the output signal;

said impeller being supported on the shaft;

the bottom of the shaft being rotatably supported on a ball which is in turn rotatably supported on a portion of the housing; and the slots extending radially to the point where the ball rotatably supports the shaft to allow fluid flowing through the slots to self-clean the ball and the bottom of the shaft.

13. The spinner tool according to claim 12 wherein the signal generating means comprises at least one magnet mounted for rotation with the impeller, and magnetically operated switch means mounted in the housing adjacent to the path of rotation of the magnet for generating the output signal in response to movement of the magnet.

14. The spinner tool according to claim 10 further characterized by means mounted on the housing for maintaining alignment of the bottom of the shaft with the ball, said alignment maintaining means being spaced apart from the ball so that the rotational support of the shaft is substantially self-cleaning under the action of fluids flowing through the housing.

15. The spinner tool according to claim 12 wherein the upper end of the shaft is conically shaped, and is received in a similarly shaped aperture formed in a depending portion of the housing.

* * * * *